United States Patent [19]

Dragone

[11] Patent Number: 4,533,919

[45] Date of Patent: Aug. 6, 1985

[54] CORRUGATED ANTENNA FEED ARRANGEMENT

[75] Inventor: Corrado Dragone, Little Silver, N.J.

[73] Assignee: AT&T Bell Laboratories, Murray Hill, N.J.

[21] Appl. No.: 542,137

[22] Filed: Oct. 14, 1983

[51] Int. Cl.[3] ..... H01Q 13/02

[52] U.S. Cl. ..... 343/786

[58] Field of Search ..... 343/781 P, 781 CA, 786

[56] References Cited

U.S. PATENT DOCUMENTS

| | | | |
|---|---|---|---|
| 3,618,106 | 11/1971 | Bryant | 343/772 |
| 3,754,273 | 8/1973 | Takeichi et al. | 343/786 |
| 4,021,814 | 5/1977 | Kerr et al. | 343/786 |
| 4,106,026 | 8/1978 | Bui-Hai et al. | 343/786 |
| 4,231,042 | 10/1980 | Turrin | 343/786 |
| 4,246,584 | 1/1981 | Noerpel | 343/786 |
| 4,295,142 | 10/1981 | Thiere et al. | 343/781 |
| 4,358,770 | 11/1982 | Satoh et al. | 343/786 |
| 4,472,721 | 9/1984 | Morz et al. | 343/786 |

OTHER PUBLICATIONS

IEEE Transactions on Antennas and Propagation, vol. AP-24(6), Nov. 1976, "Broadbanding of Corrugated Conical Horns by Means of the Ring-Loaded Corrugated Waveguide Structure", by F. Takeda et al., pp. 786-792.

IEEE Transactions on Antennas and Propagation, vol. AP-30(6), Nov. 1982, "$TE_{11}$-to-$HE_{11}$ Mode Converters for Small Angle Corrugated Horns", by G. James, pp. 1057-1062.

IEEE Transactions on Antennas and Propagation, vol. AP-30(6), Nov. 1982, "A Curved-Aperture Corrugated Horn Having Very Low Cross-Polar Performance", by B. Thomas et al., pp. 1068-1072.

Foundations for Microwave Engineering, McGraw-Hill Book Company, 1966, by R. E. Collin, pp. 226-237.

*Primary Examiner*—Eli Lieberman

*Attorney, Agent, or Firm*—Erwin W. Pfeifle

[57] ABSTRACT

The present invention relates to an antenna feed arrangement capable of providing a zero reflection response at a first frequency of interest and a maximally flat response at a widely separated second frequency of interest. The feed arrangement comprises a smooth-walled waveguide section at a first end, a corrugated waveguide section at a second end designed to provide the zero response at the first frequency, and a quarter-wave transformer waveguide section disposed between the smooth-walled and corrugated waveguide sections designed to provide the maximally flat response at the second frequency. The quarter-wave transformer section comprises a plurality of N corrugated waveguide subsections, where $N \geqq 2$, which comprise corrugation depths corresponding to the corrugation depths in the corrugated waveguide section. Additionally, the gaps between corrugations differ in adjacent subsections in a direction away from the entrance waveguide section and have a predetermined gap ratio between adjacent subsections.

5 Claims, 4 Drawing Figures

CORRUGATED ANTENNA FEED ARRANGEMENT

BACKGROUND OF THE INVENTION

1. Field of the Invention

The present invention relates to an antenna feed arrangement and, more particularly, to an antenna feed arrangement including a smooth-walled waveguide section at a first end of the feed arrangement, a corrugated waveguide section disposed at a second end of the feed arrangement which is designed to provide a zero reflection response at a first frequency of interest, and a quarter-wavelength transformer waveguide section disposed between the smooth-walled and corrugated waveguide sections which is designed to also provide a maximally flat response at a second frequency of interest to permit wide-band operation covering two widely separated frequencies of interest.

2. Description of the Prior Art

Corrugated feeds are usually characterized by a relatively large input reflection, which vanishes only at certain frequencies corresponding to the zeroes of the surface reactance due to the input corrugations. Various techniques have been devised to permit broadband operation of corrugated feeds.

One technique was disclosed in U.S. Pat. No. 4,021,814 issued to J. L. Kerr et al on May 3, 1977 where the corrugated feed included a ridge pattern with gaps therebetween in which the width of the gaps is greater than the width of the ridges.

Another technique was disclosed in U.S. Pat. No. 4,295,142 issued to H. Thiere on Oct. 13, 1981 where the horn includes a transition zone made up of a number of sections between a smooth-walled feed and a corrugated horn radiator. The corrugated section includes ring corrugations which have depths that become progressively less as they approach a subsection of regular corrugations and have apex angles which are greater than those of the regular corrugations.

A multifrequency antenna feed system is disclosed in U.S. Pat. No. 4,358,770 issued to T. Satoh et al on Nov. 9, 1982 which includes a corrugated horn and a diplexer to permit operation of two separate frequencies.

The problem remaining in the prior art is to provide a corrugated feedhorn which will operate over two widely separated frequency bands without the use of diplexers or other devices.

SUMMARY OF THE INVENTION

The foregoing problem in the prior art has been solved in accordance with the present invention which relates to an antenna feed arrangement including a smooth-walled waveguide section at a first end of the feed arrangement, a corrugated waveguide section disposed at a second end of the feed arrangement which is designed to provide a zero reflection response at a first frequency of interest, and a quarter-wavelength transformer waveguide section disposed between the smooth-walled and corrugated waveguide sections which is designed to also provide a maximally flat response at a second frequency of interest to permit wide-band operation covering two widely separated frequency bands of interest.

It is an aspect of the present invention to provide an antenna feed arrangement which comprises a quarter-wavelength transformer waveguide section disposed between a smooth-walled waveguide section and a corrugated waveguide section. The transformer section comprises a plurality of N corrugated waveguide subsections, each of the subsections comprising a longitudinal length which is essentially equal to a quarter-wavelength of a second predetermined frequency and corrugation depths which are equal to a half-wavelength of a first predetermined frequency which is spaced-apart from the second predetermined frequency. The corrugation gaps between adjacent subsections differ by a predetermined ratio to provide a maximally flat response at the second predetermined frequency.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
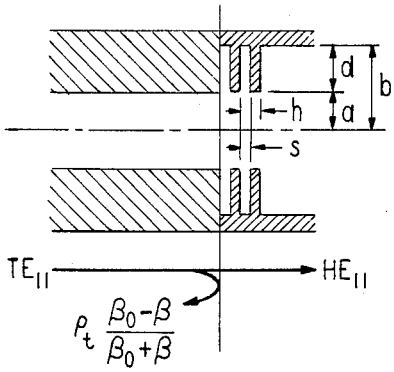
FIG. 1 (PRIOR ART)
FIG. 1 is a cross-sectional view of a junction between a corrugated waveguide section and a smooth-walled waveguide section as found in the prior art.

In general, corrugated feeds are usually characterized by an input reflection which vanishes only at certain frequencies corresponding to the zeroes of the surface reactance due to the input corrugations. The reflection in question arises due to a surface reactance discontinuity at a border 10 of the feed, as shown in FIG. 1, where a corrugated waveguide section 11 is directly connected to an uncorrugated waveguide section 12. The reflection $\rho_t$, due to the discontinuity 10 in surface reactance between two waveguides 11 and 12, is given by the equation $$\rho_t=(\beta_0-\beta)/(\beta_0+\beta) \tag{1}$$

relating $\rho_t$ to the propagation constants $\beta_0$ and $\beta$ of the dominant modes $TE_{11}$ and $HE_{11}$, respectively, of the two waveguides. The two propagation constants coincide only at certain isolated frequencies corresponding to the zeroes of the surface reactance of the input corrugations.

The feed is normally operated in the vicinity of the first zero, which is the frequency $\omega_1$ determined by the condition $$d=\frac{\lambda_r(\omega_1)}{2} \tag{2}$$

where d is the depth of the corrugations and $\lambda_r(\omega_1)$ is the wavelength for the radial waves excited in the grooves at an input frequency $\omega_1$. Using Equation (1) one can readily determine the variation of $\rho_t$ with frequency, in the vicinity of $\omega_1$.

One finds a rapid increase in $\rho_t$ with $|\omega-\omega_1|$ causing reflections greater than $-30$ dB for $\omega<0.832\ \omega_1$. Thus the junction of FIG. 1 is generally unsuitable for applications requiring negligible $|\rho_t|^2$ at widely spaced frequencies, such as for instance, 4 and 6 GHz, as required in terrestrial radio systems.

Figure 2:
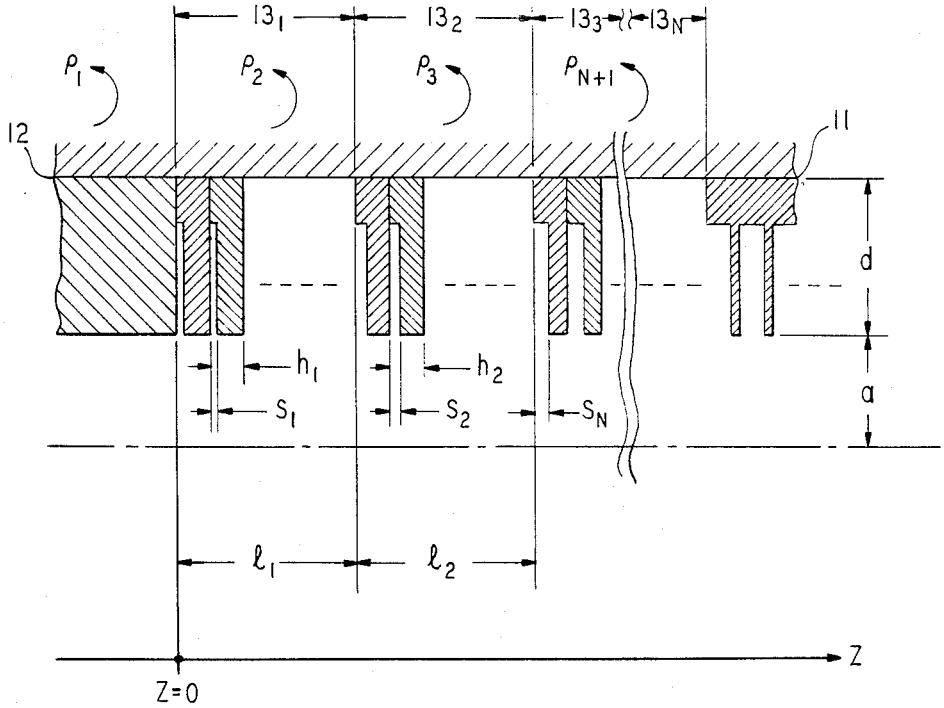
FIG. 2 is a feed arrangement in accordance with the present invention which includes a quarter-wave transformer section, comprising a plurality of N subsections, disposed between the corrugated and smooth-walled waveguide sections shown in FIG. 1.

In accordance with the present invention, a matching transformer is placed between the waveguide sections 11 and 12 of FIG. 1 to cause the reflection $\rho_t$ to approximately equal zero also in the vicinity of a frequency $\omega_0$ which is appreciably lower than frequency $\omega_1$. The overall arrangement is shown in FIG. 2 where corrugated waveguide section 11 and smooth-walled waveguide section 12 correspond to sections 11 and 12 of FIG. 1. Quarter-wave transformer section 13 is shown in FIG. 2 as comprising a plurality of N subsections of corrugated waveguide $\mathbf{13}_1$–$\mathbf{13}_N$. Each transformer subsection has corrugations with depths corresponding to those of corrugated section 11 but with increasing corrugation gaps, $s_i$, between the teeth in successive subsections from smooth-walled waveguide section 12. It is to be understood that in accordance with the present invention, transformer section 13 can comprise only two subsections $\mathbf{13}_1$ and $\mathbf{13}_2$ but can also comprise more than two subsections as shown in FIG. 2 with each subsection including a longitudinal length equal to a quarter-wavelength of the frequency $\omega_0$. The following description is directed at the general case of N transformer subsections where $N\geqq 2$.

Since all corrugations have the same depth d, the total reflection $\rho_t$ vanishes for $\omega=\omega_1$. In order to obtain $\rho_t\simeq 0$ in the vicinity of $\omega_0$ the lengths $l_i$ of the various transformer sections 13 and the values of $s_i$ are chosen by the same procedure used for multisection quarter-wave matching transformers as outlined in, for example, the book "Foundations for Microwave Engineering", by R. E. Collin, McGraw Hill, 1966 at pages 226–239. By properly choosing the parameters $l_i$ and $s_i$, one can cause $\rho_t$ to have N zeroes in the vicinity of $\omega_0$. Here these zeroes are made to coincide with $\omega_0$ to obtain a maximally flat characteristic in the vicinity of $\omega=\omega_0$. As a result the relection $\rho_t$ is very small at frequencies close to $\omega_0$ and $\omega_1$. Furthermore, it can be shown that $\rho_t$ is also small in the entire interval $(\omega_0, \omega_1)$.

To illustrate how to minimize the total reflection $\rho_t$ in FIG. 2 in the vicinity of $\omega_0$, it will be assumed that only the $HE_{11}$-mode propagates for $z>0$, and that the $TE_{11}$-mode is incident from the left. Let $M_i$ be the number of corrugations in the i-th section, and let $\lambda_{gi}$ be the wavelength for the $HE_{11}$-mode. The reflection $\rho_i$ at the i-th junction will be determined approximately using Equation (1) which is strictly valid only if $\rho_i$ is small and $$M_i>>1 \tag{3}$$

implying $h_i<<\lambda_{gi}$, where $h_i$ is the teeth separation in the i-th section.

The propagation constant $\beta$ of a mode is related to its transverse wave number $\sigma$, $$\beta a=\sqrt{(ka)^2-u^2}\ , \tag{4}$$

where $u=\sigma a$ and k is the free-space propagation constant. For the $TE_{11}$-mode, $$u=u_0=1.8411 \tag{5}$$

For the $HE_{11}$-mode in a corrugated waveguide, u is determined by s/h and d, as described, for example, in "Reflection, Transmission, and Mode Conversion in a Corrugated Feed", by C. Dragone in BSTJ, Vol. 56, No. 6, July–August, 1977 at pp. 835–867.

Assume the reflections $\rho_i$ in FIG. 2 are small, and let the frequency dependence of $\rho_i$ and $\beta_i/k$ be neglected. Then, for a maximally flat passband characteristic, $$\rho_i=\frac{1}{2^N}\ \frac{N!}{(N-1)!i!}\ \rho_t, \tag{6}$$

where N is the number of sections and $$\rho_t=\Sigma\rho_i \tag{7}$$

The reflection $\rho_i$ is related to the propagation constants $\beta_{i-1}$ and $\beta_i$ of the waveguides at the i-th junction.

$$\rho_i=\frac{\beta_{i-1}-\beta_i}{\beta_{i-1}+\beta_i}\ , \tag{8}$$

and, therefore, using Equations (4), (6) and (8), $u_1$, $u_2$, etc., can be determined if $u_O$ and $u_{N+1}$ are given. Once the $u_i$ are known, the values of $s_i/h_i$ can be determined approximately. Notice the length $l_i$ of the i-th section must be chosen so that $$l_i=(\lambda_{gi})4,\ \text{at}\ \omega_0 \tag{9}$$

In the following section the corrugated waveguide at the input of the feed, as shown in FIG. 1, will be characterized by $$b/a=1.789,\ h/s=1.256 \tag{10}$$

which can be shown to give $$ka=4.023,\ \text{at}\ \omega=\omega_1 \tag{11}$$

In light of the foregoing description, the feed arrangement in accordance with the present invention includes a quarter-wave transformer section 13 disposed between a corrugated waveguide section 11 and a smooth-walled waveguide section 12 which permits simultaneous operation at two widely separated microwave frequency bands with good response at the intermediate frequencies. The depths of the corrugations in the transformer subsections $\mathbf{13}_i$ and the corrugated waveguide section 11 is determined from Equation (2) to provide a zero response at a first desired microwave frequency $\omega_1$. Essentially, the depths of the corrugations approximately a half-wavelength of the frequency $\omega_1$. The transformer subsections $\mathbf{13}_1$–$\mathbf{13}_N$ are then designed in accordance with Equations (3)–(11) to provide reflections at each of the subsections which produce a maximally flat response at a second microwave frequency $\omega_0$ of interest.

Figure 3:
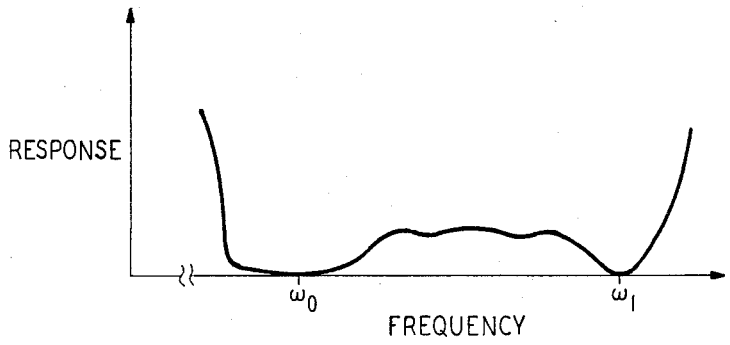
FIG. 3 illustrates a typical response curve obtainable with the arrangement of FIG. 2.

More specifically, each of the subsections $\mathbf{13}_i$ of the quarter-wave transformer comprise a longitudinal length equal to a quarter-wavelength of the frequency $\omega_0$. The gaps between the corrugations in the transformer subsections are also chosen such that Equation (6) is satisfied. Then by adjusting the ratio $S_1/S_2$ of the gaps of the adjacent subsections, e.g., subsections $\mathbf{13}_1$ and $\mathbf{13}_2$, so that the reflection $\rho_2$ will have a correct predetermined value, a maximally flat response in the vicinity of $\omega_0$ can be obtained. As defined in Equation (2), the depths of the corrugations should approximate a half-wavelength at the microwave frequency $\omega_1$ to provide a zero response at that frequency. A typical exemplary response curve which might be obtained for the antenna feed arrangement of FIG. 2 will appear as shown in FIG. 3.

Figure 4:
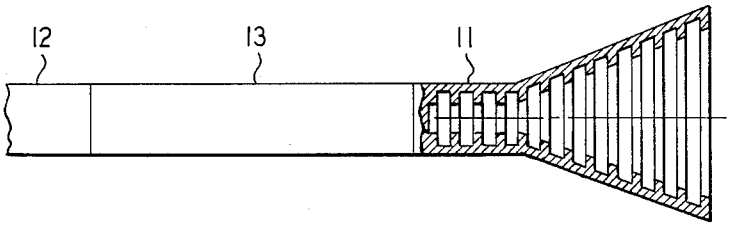
FIG. 4 is a feed arrangement similar to that of FIG. 2 where the corrugated waveguide section at the output of the feed arrangement comprises a corrugated feedhorn.

It is to be understood that the above-described embodiments are simply illustrative of the principles of the invention. Various other modifications and changes may be made by those skilled in the art which will embody the principles of the invention and fall within the spirit and scope thereof. For example, the present feed arrangement can take the form of a feedhorn by merely replacing the corrugated waveguide section 12 in FIG. 2 with a conventional corrugated feedhorn as shown in FIG. 4, which is well known in the art, that has corrugations which will provide a zero response at the frequency $\omega_1$. Such conventional feedhorn can comprise any suitable design as, for example, the feedhorn shown in FIG. 3, designated prior art, of U.S. Pat. No. 3,754,273 issued to Y. Takeichi et al on Aug. 21, 1973.

What is claimed is:

1. An antenna feed arrangement comprising:

a smooth-walled waveguide section disposed at an entrance to the antenna feed arrangement;

a corrugated waveguide section disposed at an output of the antenna feed arrangement, the corrugated waveguide section comprising corrugations of a uniform predetermined depth and gap therebetween to provide a minimum reflection at a first frequency of interest; and a quarter-wave transformer section disposed between the smooth-walled waveguide section and the corrugated waveguide section, the transformer section comprising a plurality of N corrugated waveguide subsections, where $N \geqq 2$, including corrugation depths which correspond to the corrugation depths of the corrugated waveguide section, each of the N corrugated waveguide subsections of the transformer section including gaps between corrugations which are the same for each section but which differ in size by predetermined amounts in adjacent subsections in a direction way from the smooth-walled waveguide section for generating a maximally flat response at a second frequency of interest which is separated from said first frequency of interest.

2. An antenna feed arrangement according to claim 1 wherein each of the plurality of N corrugated subsections of the transformer section comprise a longitudinal length which is equal to a quarter-wavelength of the second frequency of interest and the corrugation depths of each of the transformer subsections are equal to a half-wavelength of the first frequency of interest.

3. An antenna feed arrangement according to claim 1 wherein the gaps between corrugations within each separate corrugated transformer subsection are of the same width and the gaps between corrugations in adjacent transformer subsections differ by a separate predetermined ratio.

4. An antenna feed arrangement according to claim 2 wherein the gaps between corrugations within each separate corrugated transformer subsection are of the same width and the gaps between corrugations in adjacent transformer subsections differ by a separate predetermined ratio.

5. An antenna feed arrangement according to claim 1 wherein the corrugated waveguide section comprises:

a corrugated waveguide subsection disposed abutting the quarter-wave transformer section; and an outwardly flared corrugated feedhorn subsection with a wide end thereof disposed at the output of the antenna feed arrangement.

* * * * *